United States Patent [19]

Penneck

[11] 4,001,128

[45] Jan. 4, 1977

[54] HIGH VOLTAGE INSULATING MATERIALS

[75] Inventor: Richard John Penneck, Lechlade, England

[73] Assignee: Raychem Corporation, Menlo Park, Calif.

[22] Filed: July 21, 1972

[21] Appl. No.: 274,110

[52] U.S. Cl. ..... 252/63.2; 252/63.5; 174/137 B; 174/DIG. 1; 174/110 SR

[51] Int. Cl.[2] ..... H01B 3/00

[58] Field of Search ..... 174/DIG. 1, 137 B; 252/63.2, 63.5; 106/287 S, 308 Q, 308 B

[56] References Cited

UNITED STATES PATENTS

| | | | |
|---|---|---|---|
| 2,768,264 | 10/1956 | Jones et al. | 174/DIG. 1 |
| 2,897,173 | 7/1959 | Boggs | 260/41.5 |
| 3,042,743 | 7/1962 | Jones | 174/120 R |

OTHER PUBLICATIONS

Sterman et al., "Silane Coupling Agents", Modern Plastics Ency. Sept. 1966, vol. 44, No. 1A pp. 416–417.

Union Carbide Silanes, Union Carbide Corp. SF-1160B N.Y. City, Aug. 1966, pp. 4 and 14.

*Primary Examiner*—John D. Welsh

*Attorney, Agent, or Firm*—Lyon & Lyon

[57] ABSTRACT

A filler system for polymers is disclosed which provides high voltage insulation which is resistant to tracking. The filler system utilizes a combination of alumina trihydrate and a chemically treated silica filler. The silica-treated filler results from the exposure of an inorganic silicon-containing filler having a specific surface area of at least 40 square meters per gram to one or more silanes. Preferred silanes are substituted silanes having the formula $R_n Si X_{4-n}$ where $n$ is 1, 2 or 3, R is an organic radical bonded to the silicon atom by a Si—C bond and X is a radical bound to the silicon atom via an atom other than a carbon atom.

10 Claims, No Drawings

HIGH VOLTAGE INSULATING MATERIALS

BACKGROUND OF THE INVENTION

The field of the invention is electrical insulation and, more particularly, the present invention relates to insulation having resistance to tracking resulting from high voltage. While polymeric materials are used for insulating a wide variety of electrical apparatus, most compositions are not suitable for high voltage applications in contaminated atmospheres where moisture or fog, together with salts, dust particles and ionic pollution, cause leakage currents to flow across the surface of the insulation. This current causes a rise in temperature with consequent moisture evaporation and ultimately dry band formation. The electrical stress across these dry bands often exceeds the breakdown stress of the air-insulation interface, so that discharge or spark scintillation takes place. The spark temperature is extremely high, often 2,000° C or higher, and the heat produced may be sufficient to cause degradation of the insulation surface with the ultimate formation of carbonaceous spots. These carbonaceous spots usually link up in dendritic fashion and the organic insulation fails by progressive creepage tracking.

Over the years many solutions to these problems have been proposed of which perhaps the most effective has been the incorporation of hydrated alumina, preferably the trihydrate, in fairly substantial quantities to, for example, butyl rubber, epoxy resins, especially of the cycloaliphatic type, and, more recently, to ethylene-propylene rubbers.

There have been several suggested modes of operation for the hydrated alumina but, whatever the correct mechanism, it is found in practice that polymeric materials containing large proportions of alumina trihydrate are substantially protected against tracking and usually fail only by progressive surface erosion.

The amount of alumina hydrate required to produce the anti-tracking effect is very high, however, and is usually in the region of so – 90% by weight of the entire insulation. In the case of polymers that can be shaped by moulding or extrusion, the high filler content causes the following undesirable characteristics:

1. During the shaping operation, which can involve temperatures up to 200° C or higher, the alumina hydrate starts to lose some of its water of hydration, which at such temperatures produces steam, which in turn leads to porous products. This must be avoided at all costs, since any voids or holes in an insulation material may produce catastrophic failure by corona discharge erosion on the inside of the void, which ultimately enlarges until failure occurs. At sufficiently high voltages, failure is extremely rapid and may be complete in a few seconds.

11. In the the case of articles that are cross-linked after the shaping operation, especially by the use of high energy radiation of, for example, $\beta$-or $\gamma$-rays, the radiation can cause radiolysis of the hydrate to occur such that water is produced. This water appears to stay absorbed in the polymer/filler mixture until subsequently heated, e.g. for expansion or distortion purposes or in service, when foaming occurs. Such a foam (if a lot of filler is radiolysed) or even the formation of a few small blisters has the same catastrophic effect as the porosity described in (1).

111. In the case of heat-shrinkable articles, the heat required to operate the shrinking process at an economic rate is high enough to cause loss of the hydrated water. If the shrinking temperature is very high this loss of water may cause porosity, and, even if no porosity is produced, the loss of any water reduces the performance of the polymeric insulation under polluting conditions.

Thus it is highly desirable to eliminate or greatly to reduce the porosity or void formation or loss of water which occurs when using alumina hydrate loaded materials.

SUMMARY OF THE INVENTION

The present invention provides insulating material which is especially suitable for high voltage applications and which comprises a polymeric material and an anti-tracking filler system comprising at least 20% by weight, based on the weight of the polymeric material and the anti-tracking filler system, of alumina trihydrate and at least 1% by weight, based on the weight of the polymeric material and the anti-tracking filler system, of a chemically treated silica filler, as hereinafter defined.

DESCRIPTION OF THE PREFERRED EMBODIMENTS

By a "chemically treated silica filler" there is herein meant a filler comprising an inorganic silicon-containing compound containing the Si—O—Si group which has been treated with one or more organic silicon compounds. Such chemically treated fillers and their preparation and properties are fully described in our copending application, filed the same day as this application, the disclosure of which is incorporated herein by reference. A brief summary of these chemically treated silica fillers and their preparation will, however, now be given:

The inorganic silicon-containing filler is typically a silica or metal silicate e.g. aluminium silicate, magnesium silicate, calcium silicate or calcium aluminium silicate, normally regarded as a reinforcing filler and having a specific surface area, measured by the Brunauer, Emmett and Teller nitrogen absorption method (BET method), of at least 40 $m^2/g$, preferably at least 50 $m^2/g$. Especially advantageous fillers for use in the present invention have specific surface areas in the range of from 200 to 250 $m^2/g$. The filler may be anhydrous, i.e., containing less than 3.5% bound water, hydrated or an aerogel (prepared, for example, as described in Bachman et al., Rubber Reviews 1959, issue of Rubber and Chemistry and Technology).

To prepare the chemically treated fillers the inorganic silicon-containing fillers are treated with one or more silanes and/or with other organosilicon compounds such as octamethyl tetracyclosiloxane, tetramethylcyclosiloxane, etc. The treatment may be carried out in a number of ways. For example, the filler may be contacted with a gaseous silane, for example, dimethyl dichloro silane, at elevated temperatures, or the filler and silane may be mechanically mixed and the mixture stored until coating is complete, the time taken for the completion of the coating being in the range of one day to several weeks depending on the temperature. However, the method of treating the filler with the silane is not critical for the present invention. The filler is advantageously coated with the silane to the extent of at least one monolayer, although fillers of which a lower proportion of the surface is coated with silane may also be used in the present invention.

As silanes there are especially preferred substituted silanes of the formula $$R_nSiX_{4-n}$$

wherein $n$ is 1, 2 or 3, R represents an organic radical bonded to the silicon atom by a Si—C bond and X represents a radical bound to the silicon atom via an atom other than a carbon atom. Amongst suitable compounds are, for example, methyl trichlorosilane, dimethyl dichlorosilane, trimethyl chlorosilane, vinyl trichlorosilane, γ-methacryloxypropyl-trimethoxysilane and its hydrolysis products, γ-methacryloxypropyl-triethoxy silane and its hydrolysis products, N, N-bis (β-hydroxyethyl)- -aminopropyltriethoxy silane and its hydrolysis products, vinyl triethoxy-silane and its hydrolysis products, γ-glycidoxy-propyltrimethoxy silane, γ-mercaptopropyltrimethoxy silane and its hydrolysis products, β-(3,4-epoxycyclohexyl)-eltyl-trimethoxy silane and vinyl trimethoxy silane. Dimethyl dichlorosilane, trimethyl chlorosilane, -glycidoxy-propyltrimethoxysilane, vinyl triethoxy silane, γ-methacryloxy-propyl-trimethoxy silane, γ-methacryloxypropyl-triethoxy silane and β-(3,4-epoxycyclohexyl)ethyltrimethoxy silane are especially preferred for the preparation of chemically treated fillers suitable for use in the present invention.

The presence of functional organic R groups in the silanes makes it possible to control the compatibility and/or the reactivity of the chemically treated silica fillers with various polymers.

It has surprisingly been found that the chemically treated silica fillers substantially reduce or eliminate porosity during processing. As they are hydrophobic, they cannot be expected to absorb water released from the inorganic hydrate. Without in any way wishing to limit the present invention by theory, it is thought that it is possible that they reinforce the polymeric composition and raise its modulus thus preventing the expansion which is essential if pores are to be formed. Alternatively they may as lubricants, thereby reducing heat build-up during processing or effecting uniform dispersions of the inorganic hydrate. Even more surprisingly, they have also been found to increase the anti-tracking properties of the system.

The alumina trihydrate preferably has a high specific surface area, lying for example in the range of from 1 to 20 m²/g, especially 2 to 16 m²/g. The maximum particle size is preferably 4 microns, advantageously 2 microns. The alumina trihydrates sold under the trademarks "Hydral 705" and "Hydral 710" and identified below are especially suitable and have no surface coating:

| | "705" | "710" |
|---|---|---|
| weight % less than 2 microns | 100 | 100 |
| weight % less than 1 micron | 98 | 80 |
| weight % less than 0.5 micron | 45 | 21 |
| specific surface area m²/g | 14–17 | 6–8 |

The alumina trihydrate will generally be present in an amount in the range of from 25 to 70% by weight of the polymeric material and the anti-tracking filler system but higher proportions may be used, especially when the insulation material is not intended to be given the property of heat-recoverability. The preferred percentage of hydrate will, of course, vary according to the polymeric material into which it is incorporated (since some polymers have a greater tendency to track than others) and also according to the environment in which the insulation is to be used. However, it can readily be determined by experiment, and will in general fall within the range of from 40 to 70%, especially from 40 to 65%, by weight of the polymeric material and anti-tracking filler system.

Similarly the preferred amount of treated silica filler will generally fall within the range of from 1% to 20% by weight based on the weight of the polymeric material and the anti-tracking filler system, amounts falling within the range of from 3 to 10% by weight being preferred.

The polymer used in the insulation is preferably one having a residual char after pyrolysis of less than 10%. If the polymer has a very high residual char it may not be possible to prevent tracking even with very high loadings of the filler system. The residual char can easily be determined by a TGA measurement, for example, using a Perkin Elmer Thermobalance using flowing air at a heating rate of 40° C/min.

Among polymeric materials into which the anti-tracking system may suitably be incorporated there may be mentioned polyolefins and other olefin polymers, obtained from two or more monomers, especially terpolymers, polyacrylates, silicone polymers and epoxides, especially cycloaliphatic epoxides; among epoxide resins of the cycloaliphatic type there may especially be mentioned these sold commercially by CIBA (A.R.L.) limited under the names CY 185 and CY 183. Particularly suitable polymers include polyethylene, ethylene/methyl acrylate and ethylene/ethyl acrylate copolymers, ethylene/methyl methacrylate copolymers, ethylene/vinyl acetate copolymers, ethylene/propylene copolymers, ethylene/propylene/non-conjugated-diene, (e.g. 1,4-hexadiene, dicyclopentadiene, ethylidene norbornene) terpolymers, chlorosulphonated polyethylene, polypropylene, polydimethyl siloxane, dimethyl siloxane/methyl vinyl siloxane copolymers, fluoro silicones, e.g. those derived from 3,3,3-trifluoropropyl siloxane, carborane siloxanes, e.g. "Dexsil" polymers made by Olin Mathieson, polybutyl acrylate, butyl/ethyl acrylate copolymers, butyl acrylate/glycidyl methacrylate copolymers, polybutene, butyl rubbers, ionomeric polymers, e.g. "Surlyn" materials sold by Du Pont, or mixtures of any two or more of the above.

Especially useful insulation materials of the present invention are cross-linked and, preferably, imparted with the property of heat-recoverability. For example, the insulation may take the form of heat-shrinkable tubes, udders and sheds for use in cable connections or heat shrinkable end-caps for cable terminations. The present invention therefore also provides shaped articles comprising the insulation material of the present invention which articles may, if desired, be in a heat-recoverable form.

The present invention also provides a mouldable or extrudable composition suitable for processing into the insulating material of the present invention which comprises a mixture of one or more polymers and an anti-tracking filler system comprising at least 20% by weight, based on the weight of the polymer (s) and the anti-tracking filler system, of alumina trihydrate and at least 1% by weight, based on the weight of the polymer(s) and the anti-tracking filler system, of a chemically treated silica filler, as hereinbefore defined.

The insulating materials and compositions of the present invention may, if desired, contain other fillers, for example, flame retardants, reinforcing fillers, pigments and mixtures thereof. The anti-tracking filler system and any other fillers etc. can be incorporated into the polymer(s) by any of the commonly used techniques, for example, in twin-roll mills, Banbury mixers or compounding extruders.

Similarly the resulting compositions can readily be processed into sheets of material or other shaped articles by any of the usual methods.

The insulation materials of the present invention are especially useful in high-voltage applications, for example, at voltages up to 11 KV or even higher up to, for example, 33 KV, e.g. as termination for paper cables. Accordingly, the present invention also provides high-voltage electrical apparatus in which a component is insulated by such insulating materials.

The following Examples illustrate the invention, all parts and percentages being by weight unless otherwise stated:

EXAMPLES 1 – 5

The following formulations were prepared on a twin-roll laboratory mill at 120° C, the amounts shown being in parts by weight.

| Formulation No. | 1 | 2 | 3 | 4 | 5 |
|---|---|---|---|---|---|
| Ethylene-propylene-dicyclopentadiene terpolymer | 50 | 50 | 50 | 50 | 50 |
| Ethylene-ethyl acrylate copolymer | 50 | 50 | 50 | 50 | 50 |
| Low density polyethylene MFI 3.0 (MFI = Melt Flow Index) | 40 | 40 | 40 | 40 | 40 |
| Polymerized dihydroquinoline antioxidant | 8 | 8 | 8 | 8 | 8 |
| Alumina hydrate (BET area 1.7 $m^2/g$) | 150 | 150 | 150 | 150 | 150 |
| "Aerosil R972" (treated silica filler) | 10 | — | — | — | — |
| "Aerosil 200" (untreated silica filler) | — | 10 | — | — | — |
| "Aerosil 200" + Silane "A186" (treated silica filler) | — | — | 10 | — | — |
| "Aerosil 200" + Silane "A187" | — | — | — | 10 | — |
| "Aerosil 200" + Silane "A151" (treated silica filler) | — | — | — | — | 10 |
| Triallyl cyanurate | 2 | 2 | 2 | 2 | 2 |
| 2,5 dimethyl 2,5 di tert butyl peroxy hexyne-3 | 4 | 4 | 4 | 4 | 4 |

"Aerosil R972" is a trademark for a silica filler coated with trimethyl chlorosilane, and having a BET surface area of about 150 $m^2/g$.

"Aerosil 200" is a trademark for an untreated silica filler having a surface area of approximately 200 $m^2/g$.

The Silanes are indicated above by their trademarks and are identified as follows. "A186" β-(3,4-epoxy cyclohexyl)-ethyl trimethoxy silane "A187" γ-glycidoxy propyl trimethoxy silane "A151" Vinyl triethoxy silane The "Aerosil 200" was coated with the above silanes by shaking a mixture consisting of "Aerosil 200" and 5% by weight of the "Aerosil" of the silane in a polythene bag for 1 week at room temperature.

Plaques 5 × 2 × 0.25 inches were passed at 200° C for 15 minutes for physical and electrical tests.

Formulation 2 bubbled on pressing, but the others gave no porosity. Physical properties determined for the other formulations were as follows:

| Formulation No. | 1 | 3 | 4 | 5 |
|---|---|---|---|---|
| Tensile Strength p.s.i. | 695 | 1223 | 1250 | 1270 |
| % elongation at break | 610 | 285 | 305 | 265 |
| Electric Strength, volts per 0.001 in. | 535 | 650 | 590 | 610 |

Formulations 3 and 4 were tested according to ASTM D2303 (which measures the tracking and erosion resistance of polymeric insulators by the liquid contaminant inclined plane method) using a contaminant comprising 0.02% Triton X-100 as the wetting agent and 0.1% ammonium chloride and having a resistivity of 330 ohms-cms. The flow rate was 0.15 mls/min and the start up voltage was 2.0 KV. After every hour, the voltage was raised by 0.25 KV.

After a total test period of 200 mins., testing of Formulation 3 was terminated as the sample was no longer able to support due to the large eroded crater present. There was no tracking at all. Similarly, Formulation 4 was removed at 200 mins., again with no tracking present, only a large erosion crater.

EXAMPLES 6 – 8

The following formulations expressed in parts by weight were prepared by milling on a laboratory mill. Test plaques were pressed at 200° C for 15 minutes.

| Formulation No. | 6 | 7 | 8 |
|---|---|---|---|
| Silicone "Elastomer E361" | 70 | 70 | 70 |
| Low density polyethylene M.I. 3.0 | 20 | 20 | 20 |
| Alumina trihydrate (BET 1.7 $m^2/g$) | 30 | 30 | 30 |
| $Fe_2O_3$ | 5 | 5 | 5 |
| "Aerosil R972" (treated) | — | — | 5 |
| "Aerosil 200" (untreated) | — | 5 | — |
| Triallyl cyanurate | 0.2 | 0.2 | 0.2 |
| 2,5-dimethyl-2,5-di tert-butyl peroxy hexyne-3 | 0.2 | 0.2 | 0.2 |

"Elastomer E-361" is a trademark for a silicone elastomer derived from methyl phenyl, methyl vinyl and dimethyl siloxane with sufficient treated filler to give a shore hardness of 60. Formulations 6 and 7 foamed immediately on pressing and a plaque suitable for measurement of physical properties could not be obtained.

The properties of Formulation 8 were as follows:

| | |
|---|---|
| Tensile Strength | 1290 p.s.i. |
| Elongation at break | 455% |
| Electric Strength | 310 volts per 0.001 in. |
| Specific Gravity | 1.20 |

This Example clearly shows that use of the treated fillers of the invention prevents porosity being formed in articles made from the formulations.

Formulation 8 was tested according to ASTM D2303 using a contaminant comprising 0.02% glycerol-ethylene oxide condensate sold under the trademark "Conox Y102" as the nonionic wetting agent and 0.1% ammonium chloride and having a resistivity of 380 ohm-cms at 23° C. A test voltage of 3 KV was used with a contaminant flow rate of 0.30 mls per minute.

The time to track 1 inch was 1418 minutes.

Similar formulations to Formulations 6 – 8 contained 70 parts of "Dow Corning Silicone 6565U" in place of I.C.I. "Elastomer E361". The porosity results were similar to those obtained in Examples 6 to 8 and only the formulation containing "Aerosil R972" was free of porosity after processing. The time to track 1 inch of this sample was 1580 minutes.

EXAMPLES 9 – 14

The following formulations expressed in parts by weight were prepared on a laboratory mill:

| Formulation No. | 9 | 10 | 11 | 12 | 13 | 14 |
|---|---|---|---|---|---|---|
| Ethylene-propylene dicyclopentadiene terpolymer | 100 | 100 | 100 | 100 | 100 | 100 |
| Low density polyethylene MFI 3.0 | 33 | 33 | 33 | 33 | 33 | 33 |
| Ethylene-ethyl acrylate copolymer | 33 | 33 | 33 | 33 | 33 | 33 |
| Chlorosulphonated polyethylene sold under the trademark "Hypalon 40" | 30 | 30 | 30 | 30 | 30 | 30 |
| "Aerosil R972" (treated) | 10 | 10 | 10 | 10 | 10 | 10 |
| Polymerized 1,2 dihydro-2,2,4-trimethylquinoline sold under the trademark "Agerite Resin D" | 6 | 6 | 6 | 6 | 6 | 6 |
| Magnesium oxide | 10 | 10 | 10 | 10 | 10 | 10 |
| Alumina trihydrate (BET 1.7 $m^2/g$) | 150 | 175 | 200 | 225 | 250 | 275 |
| $Fe_2O_3$ | 10 | 10 | 10 | 10 | 10 | 10 |
| 2,5-dimethyl-2,5-di tert-butyl peroxy hexyne-3 | 5 | 5 | 5 | 5 | 5 | 5 |

Test plaques were pressed at 200° C for 15 minutes. No porosity was found in any of the formulations, illustrating very well the effect of the treated silica filler even at high loadings of alumina trihydrate.

The following physical properties were observed for the samples:

| Test / Formulation No. | 9 | 10 | 11 | 12 | 13 | 14 |
|---|---|---|---|---|---|---|
| 23° C | | | | | | |
| Tensile Strength p.s.i. | 1405 | 1270 | 1330 | 1255 | 1030 | 895 |
| % Elongation at break | 475 | 525 | 475 | 470 | 445 | 415 |
| Electric Strength volts/0.001 ins. | 335 | 325 | 340 | 320 | 325 | 310 |
| 150° C | | | | | | |
| Tensile Strength p.s.i. | 270 | 220 | 285 | 290 | 270 | 210 |
| 100% Modulus p.s.i. | 215 | 150 | 235 | 230 | 230 | 170 |
| % elongation at break | 150 | 300 | 175 | 200 | 165 | 205 |
| 200° C | | | | | | |
| Tensile Strength p.s.i. | 275 | 205 | 275 | 265 | 250 | 220 |
| 100% Modulus p.s.i. | 230 | 125 | 235 | 220 | 210 | 185 |
| % Elongation at break | 160 | 285 | 155 | 165 | 125 | 165 |

Some of the formulations were tested to ASTM D2303 at a constant voltage of 6 KV using a contaminant comprising 0.02% glycerol-ethylene oxide condensate (Conox Y102) as the wetting agent and 0.1% ammonium chloride and having a resistivity of 380 ohms cm at 23° C. The contaminant flow rate was 0.30 mls per minute.

| Formulation No. | Time to track 1 in. at 6 KV mins. |
|---|---|
| 10 | 1117 |
| 11 | 1254 |
| 12 | 1672 |

Examples 15 – 17

The following formulations were prepared on a laboratory mill:

| Formulation No. | 15 | 16 | 17 |
|---|---|---|---|
| Silicone "Elastomer E322/60" | 30 | 30 | 30 |
| Low density polyethylene MFI 3 | 15 | 15 | 15 |
| Ethylene-ethyl acrylate copolymer (18% acrylate) | 15 | 15 | 15 |
| Ethylene-propylene 1-4 hexadiene terpolymer | 30 | 30 | 30 |
| "Aerosil R972" | — | 10 | — |

-continued

| Formulation No. | 15 | 16 | 17 |
|---|---|---|---|
| "Aerosil 200" + 5% "Silane A186" | — | — | 10 |
| Alumina trihydrate (BET 1.7 $m^2/g$) | 70 | 70 | 70 |
| $Fe_2O_3$ | 10 | 10 | 10 |
| Polymerized 1,2 dihydro 2,2,4 trimethyl-quinoline sold under the trademark "Agerite Resin D" | 2 | 2 | 2 |
| Triallyl isocyanurate | 2 | 2 | 2 |
| 2,5-dimethyl-2,5-di tert butyl peroxy hexyne-3 | 5 | 5 | 5 |

"Elastomer E 322/60" is the trademark for a silicone elastomer derived from dimethyl siloxane and about 0.2 mole per cent methyl vinyl siloxane. The elastomer contains sufficient treated filler to give a shore hardness of 60. In Formulation 17, the "Aerosil 200" was treated with the silane by shaking the mixture in a polythene bag for 1 week followed by heating at 100° C for 4 hours.

These samples were pressed as before into plaques for testing the electrical properties to ASTM D2303. Formulation 15 contained bubbles and on cutting and tearing exhibited poor lamination and fibrous tear. The other samples 16 and 17 were satisfactory and the tracking test results were outstanding.

Under the same conditions as in Examples 10 to 12, the time to track exceeded 5000 mins. for both formulations.

EXAMPLES 18 – 20

The following formulations expressed in parts by weight were prepared on a twin roll mill at about 110° C:

| Formulation No. | 18 | 19 | 20 |
|---|---|---|---|
| Ethylene-propylene-dicyclo-pentadiene terpolymer | 130 | 100 | 130 |
| Ethylene-ethyl acrylate copolymer | — | 30 | — |
| Low density polyethylene (M.F.I. 3.0) | 40 | 40 | 40 |
| Polymerised tetrahydro-quinoline antioxidant | 8 | 8 | 8 |
| Ferric oxide | 20 | 20 | 20 |
| Chemically treated silica filler | 20 | 20 | 20 |
| Alumina trihydrate | 150 | 150 | 200 |
| Triallyl cyanurate | 2 | 2 | 2 |

The chemically treated silica filler consisted of a silica aerogel coated with dimethyl dichlorosilane to approximately one monolayer. This filler had a specific surface area of approximately 150 sq. m/g (BET method) and an average particle size of 20$\mu$.

These formulations were extruded into tubing of internal diameter 1.0 in. and wall thickness 0.110 in. at temperatures up to 150° C (at the extruder die) with good surface finish and no porosity.

By way of comparison, a similar formulation was prepared which was identical to Formulation 18 except that no filler additive was present and this, when extruded as before, produced tubing of rough surface appearance and some internal bubbles and it was not possible to eliminate the bubbles present in the tubing by varying extrusion conditions.

All these formulations were pressed into plaques 5 × 2 × 0.25 in. and irradiated under nitrogen with $\gamma$-rays to a dose of 15 Mrads. Those plaques were then tested according to ASTM D2303 at a constant voltage of 6 KV. The contaminant used comrpised 0.1% of glycerol-ethylene oxide condensate sold under the trademark "Conox Y102" and 0.1% ammonium chloride and had a resistivity of 380 ohms-cm at 23° C. The contaminant flow rate was 0.9 mls/minute. The results were as follows:

| Formulation | Time to track 1 inch at 6 KV (mins) |
|---|---|
| Control (porosity) | 42 |
| 18 | 770 |
| 19 | 1000 |
| 20 | 1000 |

These results demonstrate the remarkable improvement in tracking resistance and lack of porosity conferred by the addition of the chemically treated silica filler.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

I claim:

1. Blended anti-tracking insulating material suitable for high voltage applications consisting essentially of an organic synthetic polymeric materials and an anti-tracking filler system wherein the polymeric material is at least 10% by weight of the insulating material, and the anti-tracking filler system comprises at least 20% by weight of alumina trihydrate based on the weight of the polymer and filler system and at least 1% by weight of an organic silicon-containing compound containing the Si—O—Si group which has been coated prior to blending of said material and system with at least one organosilicon compound, based on the weight of the polymer and filler system, wherein said organosilicon compound is a silane of the formula:

$$R_nSiX_{4-n}$$

wherein $n$ is an integer no higher than 3, R represents an organic radical bonded to the silicon atom by a Si—C bond and X is selected from the group consisting of chlorine or a radical bonded to silicon by an oxygen atom.

2. Blended anti-tracking insulating materials suitable for high voltage applications consisting essentially of at least 10% by weight of an organic synthetic polymer selected from the group consisting of polyolefins, polyacrylates, silicon polymers, polyepoxides, butyl rubbers, ionomeric polymers, polyvinul acetate and copolymers or terpolymers thereof having a residual char after pyrolysis of less than 10%, at least 20% by weight of alumina trihydrate and at least 1% by weight of an inorganic silicon-containing compound selected from the group consisting of silica or metal silicate which has been coated prior to blending of said polymer, alumina trihydrate and filler with a silane of the formula:

$$R_nSiX_{4-n}$$

wherein $n$ is an integer no higher than 3, R is an organic group bonded by a Si—C bond and X is a radical selected from the group consisting of chlorine or a radical bonded to silicon by an oxygen atom.

3. The insulating material of claim 1 wherein the alumina trihydrate is present in an amount of from 25% to 70% and wherein the coated silicon-containing compound is present in an amount of from 11 to 20%, each by weight of the polymeric material and the anti-tracking filler system, and wherein the specific surface area of the inorganic silicon-containing compound measured by the BET method is at least $40^{-2}/q$, the polymeric material being one having a residual char after pyrolysis of not greater than 10% by weight.

4. The insulating material of claim 3 wherein the polymeric material is cross-linked and heat recoverable.

5. The insulating material of claim 7 wherein the alumina trihydrate is present in an amount of from 25% to 70% and the coated silicon-containing compound is present in an amount of from 1% to 20%, each by weight of the polymeric material and the anti-tracking filler system, and wherein the specific surface area of the inorganic silicon-containing compound measured by the BET method is at least $40_m2/g$.

6. The insulating material of claim 5 wherein the specific surface area of the inorganic silicon containing compound lies in the range of from 200 to 250 $m^2/g$.

7. The insulating material of claim 5 wherein the specific surface area of the alumina trihydrate lies in the range of from 1 to 20 $m^2/g$.

8. The insulating material of claim 2 wherein the silane is selected from the group consisting of dimethyl dichlorosilane, trimethyl chlorosilane, γ-glycidoxypropyltrimethoxysilane, vinyl triethoxy silane, γ-methacryloxypropyl trimethoxy silane, γ-methacryloxypropyl triethoxy silane, and β-(3,4-epoxycyclohexyl)-ethyl trimethoxy silane.

9. The insulating material of claim 1 wherein the polymeric material is cross-linked and heat-recoverable.

10. The insulating material of claim 1 wherein said silane is selected from the group consisting of dimethyldichlorosilane, trimethyl chlorosilane, gamma-glycidoxypropyltrimethoxysilane, vinyl triethoxy silane, gamma-methylacryloxypropyl trimethoxy silane, gamma-methylacryloxy propyl triethoxy silane, and beta-(3,4-epoxycyclohexyl)-ethyl trimethoxy silane.

* * * * *